United States Patent [19]

Blewett et al.

[11] Patent Number: 4,903,604

[45] Date of Patent: Feb. 27, 1990

[54] IGNITION TRANSFER MEDIUM

[75] Inventors: Francis M. Blewett; Gary E. J. Pike, both of Salisbury; Anne F. Sykes, Hertford, all of England

[73] Assignee: The Secretary of State for Defence in Her Majesty's Government of Great Britain and Northern Ireland, London, United Kingdom

[21] Appl. No.: 311,308

[22] Filed: Feb. 16, 1989

Related U.S. Application Data

[63] Continuation at PCT GB87/00421 filed Jun. 17, 1987, published as W087/07888 on Dec. 30, 1987, abandoned.

[30] Foreign Application Priority Data

Jun. 17, 1986 [GB] United Kingdom ..... 8614674

[51] Int. Cl.[4] ..... B41F 31/02; C06B 45/30

[52] U.S. Cl. ..... 102/364; 102/275.3; 102/275.9; 102/482; 102/487; 149/5; 149/6; 149/108.2; 427/389.9

[58] Field of Search ..... 149/5, 6, 108.2; 102/364, 482, 275.3, 275.9, 487; 427/389.9; 423/447.2

[56] References Cited

U.S. PATENT DOCUMENTS

| | | | |
|---|---|---|---|
| 2,841,481 | 7/1958 | Hall | 149/19.1 |
| 3,513,776 | 5/1970 | Driscoll | 102/38 |
| 3,667,396 | 6/1972 | Barrett | 60/256 |
| 3,760,729 | 9/1973 | Freeman | 102/32 |
| 4,072,546 | 2/1978 | Winer | 149/19.8 |
| 4,122,671 | 10/1978 | Armstrong et al. | 60/218 |
| 4,140,561 | 2/1979 | Keith et al. | 149/2 |
| 4,256,607 | 3/1981 | Yoshida et al. | 423/447.7 |
| 4,310,007 | 1/1982 | Auersbacher | 131/329 |
| 4,401,588 | 8/1983 | Turner | 423/447.7 |
| 4,406,815 | 9/1983 | Magnusson et al. | 149/108.2 |
| 4,565,727 | 1/1986 | Giglia et al. | 428/172 |
| 4,756,778 | 7/1988 | Dietz et al. | 149/108.2 |
| 4,770,099 | 9/1988 | Brede et al. | 102/472 |
| 4,799,979 | 1/1989 | Baldi | 149/5 |
| 4,819,612 | 4/1989 | Okamoto et al. | 102/275.1 |

*Primary Examiner*—Edward A. Miller

*Attorney, Agent, or Firm*—Nixon & Vanderhye

[57] ABSTRACT

An ignition transfer medium for interconnecting the ignition and pyrotechnic stages of a pyrotechnic device comprises activated fibrous carbon, such as activated charcoal cloth, on which an inorganic oxidizer and possibly other substances have been deposited.

12 Claims, 4 Drawing Sheets

IGNITION TRANSFER MEDIUM

Figure 1:
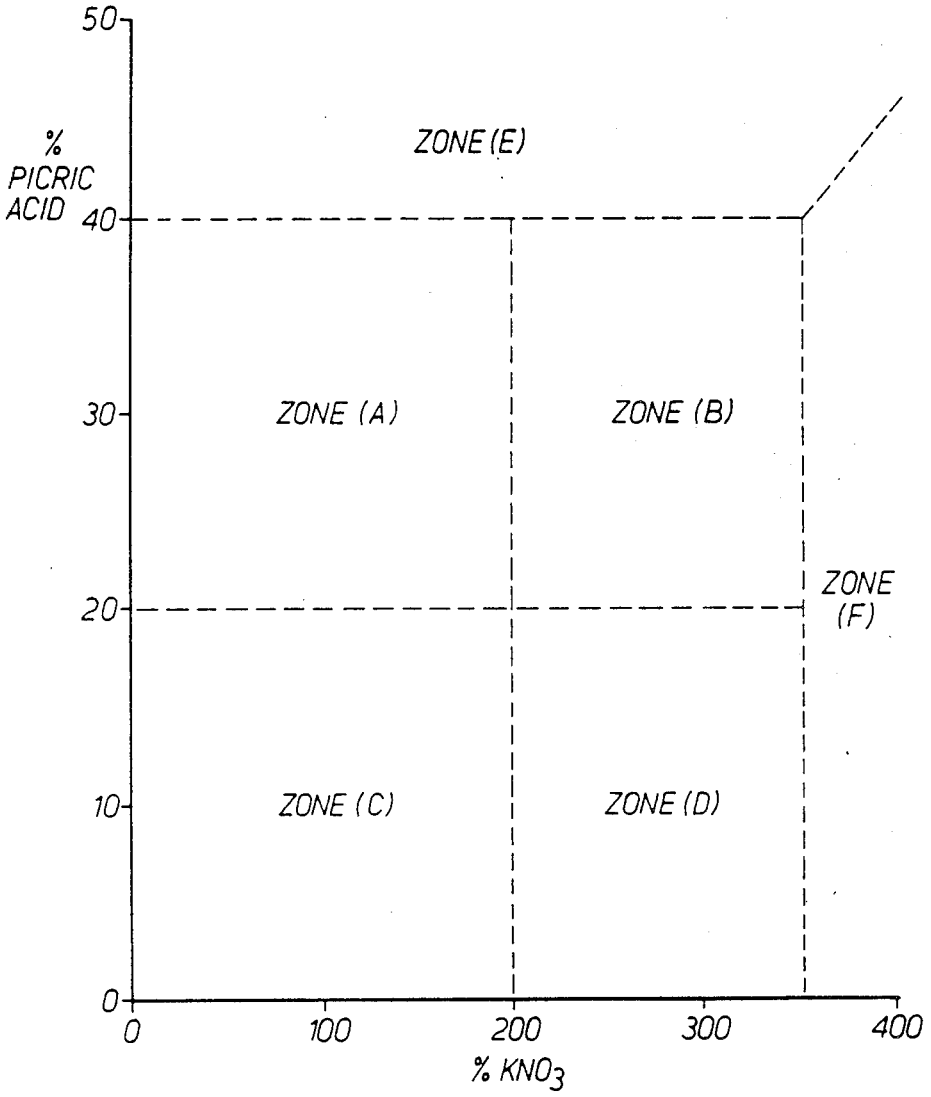

This application is a continuation of PCT international application No. PCT/GB87/00421, filed on 17 June 1987, as to which the U.S.A. was designated. The U.S.A. designation application is now abandoned, and the original PCT application has been published as WO 87/07888.

This invention relates to an ignition transfer medium used as a means for inter-connecting the ignition and later combustion stages of pyrotechnic systems in order to transfer burning after initiation to the next stage. This invention also relates to methods of fabricating the ignition transfer medium, and to the use of the medium in a pyrotechnic device.

As well as providing a physical link in the burning train, a prime function of the transfer medium is to build up heat after the operation of the igniter to a level at which further combustion of the system is promoted. The medium must therefore be ignited easily and produce a controlled pyrotechnic reaction in the absence of atmospheric oxygen, enclosed as it may be inside the casing of a smoke grenade, for example. It has been found however that too vigorous a reaction may induce a physical breakdown of the pyrotechnic front leading to self-extinction, and it is therefore a requirement for the burning rate to be predictable and reproducible, above a minimum rate dependent on the application and below that which could lead to breakdown.

Hitherto, the material used for such a medium has usually been a fabric, cambric, primed with either sulphurless mealed powder (SMP), which is a mixture of finely ground charcoal and potassium nitrate in the approximate ratio by weight of 30:70, or with the pyrotechnic composition SR 252. The pyrotechnic mixture has normally been bonded to the cambric by gum arabic, and even though no bonding compound superior in general performance to gum arabic has been found, primed cambrics suffer from ageing and lack of durability on handling. Although cambric is strong and flexible enough to act as a support, the layers of pyrotechnic mixture bonded on each side of the cambric tend to abrade very easily, and on bending the mixture tends to crack and flake. After the pyrotechnic mixture has burned, the cambric exhibits an "afterglow" which can be highly desirable in order to maintain the space at a high temperature to facilitate ignition of the later combustion stages.

Attempts have now been made to replace cambric as the support with fibrous activated carbon and highly satisfactory results have been obtained. According to the first aspect of the present invention, therefore, there is provided an ignition transfer medium comprising an activated carbon support onto which an oxidant has been deposited. It has been found that it is not necessary to use gunpowder-type mixture if fibrous activated carbon is used as the support since the activated carbon fibres are sufficiently close to the oxidant molecules that on ignition the carbon support itself becomes the oxidised substance thus replacing, for example, the charcoal component of SMP. The oxidant, moreover, being deposited largely within the fibre structure of the carbon support, is less prone to flaking or abrading during handling.

The fibrous activated carbon support is preferably provided in the form of a consolidated layer of fibres, for examples as a felt or as a woven cloth. An activated carbon cloth, which is often referred to as charcoal cloth, is most preferred because its strength and thickness more closely resembles that of conventional primed cambric which the present ignition transfer medium seeks to replace. The activity of the fibrous carbon, as measured by its specific heat of wetting with silicone, is preferably beteen 20 $Jg^{-1}$ (low activity) and 120 $Jg^{-1}$ (high activity), most preferably between 30 and 100 $Jg^{-1}$. A fibrous activated carbon with a heat of wetting of greater than 120 $Jg^{-1}$ will have low fibre strength and an ignition transfer medium made from it will tend to disintegrate rapidly once ignited. On the other hand, using low activity fibrous activated carbon (heat of wetting less than 20 $Jg^{-1}$) it is difficult to ensure that the carbon is impregnated with sufficient oxidant to sustain an exothermic reaction once ignited.

The oxidant is preferably an inorganic oxidant, more preferably an inorganic salt which is soluble in water and so can be deposited onto the fibrous activated carbon from solution. The amount by weight of oxidant deposited on the carbon is preferably between 100% and 1000%, more preferably from 150% to 800% (these percentage figures and subsequent ones representing the ratio of dry oxidant to dry fibrous activated carbon by weight expressed as a percentage). A fibrous activated carbon having less than 100% oxidant deposited thereon will tend to require oxygen to support combustion whereas a fibrous activated carbon having more than 1000% oxidant deposited thereon will tend to have an unacceptably low burning rate or to self extinguish due to the presence of excess oxidant.

Although nitrates, nitrites, chlorates, perchlorates, (including perchloric acid), chromates and dichromates among inorganic oxidants are potentially suitable for use with fibrous activated carbon in the manner just described, of those investigated nitrates and particularly metal nitrates have been found to have the most suitable properties. The oxidant is preferably in the form of its alkali metal or ammonium salt, although a broader range of anions for nitrate salts can be used. Potassium nitrate has been found to be an especially suitable oxidant. It is, for example, highly soluble in water and it can be easily deposited on charcoal cloth by dipping the cloth into aqueous solution and allowing the cloth to dry. In the burning of fibrous activated carbon impregnated with potassium nitrate, an equation which may express the oxidation process is $$5C+4KNO_3=2K_2CO_3+3CO_2+2N_2,$$

and this suggests that complete oxidation of the carbon should occur if the transfer medium containes 670% $KNO_3$. However, a transfer medium containing over 350% $KNO_3$ —and frequently with lower figures - usually burns without leaving a charcoal skeleton, especially if high activity fibrous carbon is used, since although not all the carbon may have been oxidised the reaction is sufficiently vigorous to disperse the remaining carbon. In additon, the burning rate of such a cloth decreases above 350% $KNO_3$ because, it is surmised, much of the $KNO_3$ above this figure is not in such good contact with the charcoal fibres and its presence inhibits the movement of hot gases along the cloth surface. On the other hand, a fibrous activated carbon support containing less than about 150% $KNO_3$ requires oxygen to support combustion and with up to 200% $KNO_3$, few flames are produced.

The potential heat output of such a material, and the way in which it burns, may however be changed by the inclusion of one or more additional substances which may produce an exothermic reaction in a manner complementary to the first oxidant or, for example, preserve a fibrous carbon skeleton at higher heat output levels.

Such additional substances may or may not be oxidants and suitable substances for increasing the heat output have been found to be energetic compounds. These are compounds defined, for the purpose of this specification, as compounds which are capable of sustaining an exothermic gas-producing reaction in the absence of an oxidising or reducing agent. Explosive compounds fall within the scope of this definition. The compounds are conveniently organic compounds, preferably nitrated aromatic compounds, since it has been found that these compounds may be readily adsorbed into the activated carbon fibres from solution. The amount of organic energetic material adsorbed will vary depending on solution strength and acivated carbon activity, but will typically be in the range of 2%–200%, especially 5%–75% by weight of dry activated carbon.

An especially preferred organic energetic compound is picric acid (2,4,6-trinitrophenol). Picric acid is well known as an explosive but it has not hitherto been used for the present purpose. Even when deposited on fibrous activated carbon, in the absence of other oxidants it will either burn only in the presence of atmospheric oxygen or, in higher concentrations, burn so violently as to rupture the carbon support. It has been found to be preferentially adsorbed out of an organic, eg alcohol, or agueous solution into the interstitial spaces within the activated carbon fibres. Up to 55% picric acid, depending on the activity of the activated carbon, can be adsorbed on to the carbon support in this way (A high activity carbon support, having been additionally reduced in the manufacturing process, has the highest surface area and accordingly the highest capacity to adsorb molecules, although possessing a correspondingly smaller tensile strength. A lower activity carbon support has a correspondingly lower maximum adsorption figure).

The ability of the fibrous activated carbon support to adsorb picric acid and other organic energetic compounds is not affected by the simultaneous deposition of an inorganic oxidant, and vice versa. It is possible therefore to manufacture a material based on fibrous activated carbon in which firstly picric acid is incorporated by adsorption from solution and secondly an oxidant such as potassium nitrate is added from aqueous solution as mentioned above. Alternatively, oxidants may be applied to the fibrous activated carbon support simultaneously, for example by using an aqueous solution containing both picric acid and potassium nitrate. Such a material containing picric acid and potassium nitrate behaves in many ways, depending on the respective concentrations of these two compounds.

As mentioned above, with less than about 150% $KNO_3$ the material burns either weakly or not at all, and with more that 350% $KO_3$ the reaction is too fierce to leave remains from which an afterglow can be obtained. With up to about 20% of picric acid however, materials having between 100% and 350% $KNO_3$ can be produced which burn well and may leave a skeleton support, and with sufficient pyrotechnic material these will produce enough heat at least to match the performance of primed cambrics and are more durable, reliable and reproducible. At these levels of picric acid, lower levels of $KNO_3$ (down to about 100%) are required to support combustion but at levels of picric acid above about 25%, any burning leaves no trace of a charcoal skeleton. Nevertheless, even at higher levels of picric acid—up to about 45%—it is found that the burning is smoother and faster than with cloths used previously. The mechanical properties of a fibrous activated carbon support (such as charcoal cloth) which contains a crystalline oxidant deposited interstitially can be improved by the addition of a flexible material which forms a thin layer on the cloth or binds the crystals on the fibres. Suitable binding agents include polyurethane dispersions, and Impranil DLH, marketed by Bayer (UK) Ltd., has been found to be satisfactory.

According to a further aspect of the present invention, there is provided a pyrotechnical device comprising a hollow body containing a pyrotechnic charge, ignition means for igniting the pyrotechnic charge, and an ignition transfer medium according to the first aspect of this invention disposed between the ignition means and the pyrotechnic charge. The pyrotechnic charge may comprise a plurality of sub-charges each at least partly surrounded by ignition transfer medium.

Figure 2:
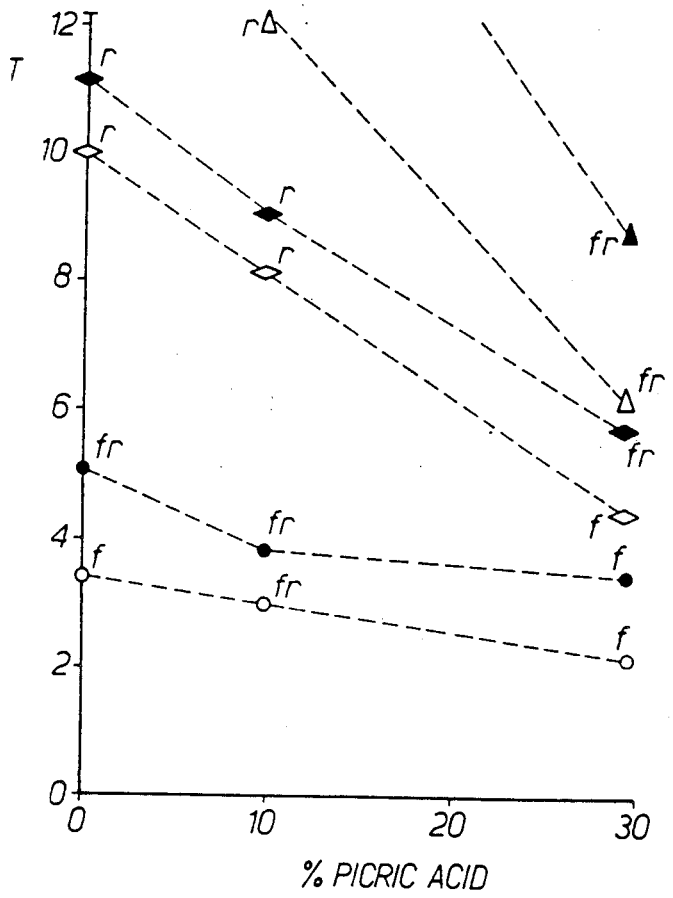
Figure 3:
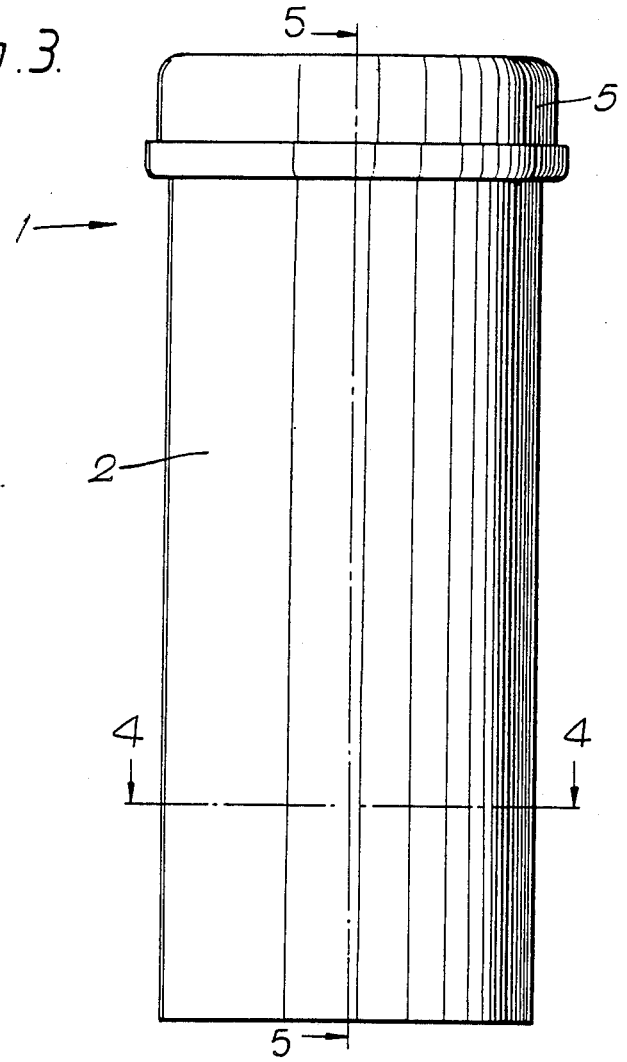

Examples of the present ignition transfer means and a specific embodiment of a pyrotechnic device incorporating same will now be described with reference to the accompanying drawings in which FIG. 1 depicts the nature of the burning observed experimentally and produced by igniting a medium activity charcoal cloth (specific heat of wetting with silicone: 35 $Jg^{-1}$) containing various concentrations of $KNO_3$ and picric acid, FIG. 2 is a graphical illustration of the effect on burning rate of a charcoal cloth containing various quantities of inorganic oxidant, picric acid, and binding agent, FIG. 3 is an elevation of a pyrotechnic device showing lines AA' and BB'

Figure 4:
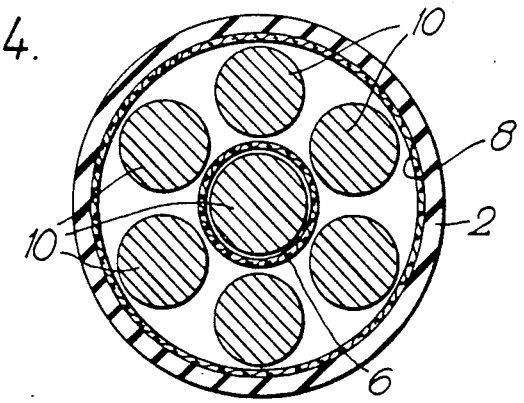
Figure 5:
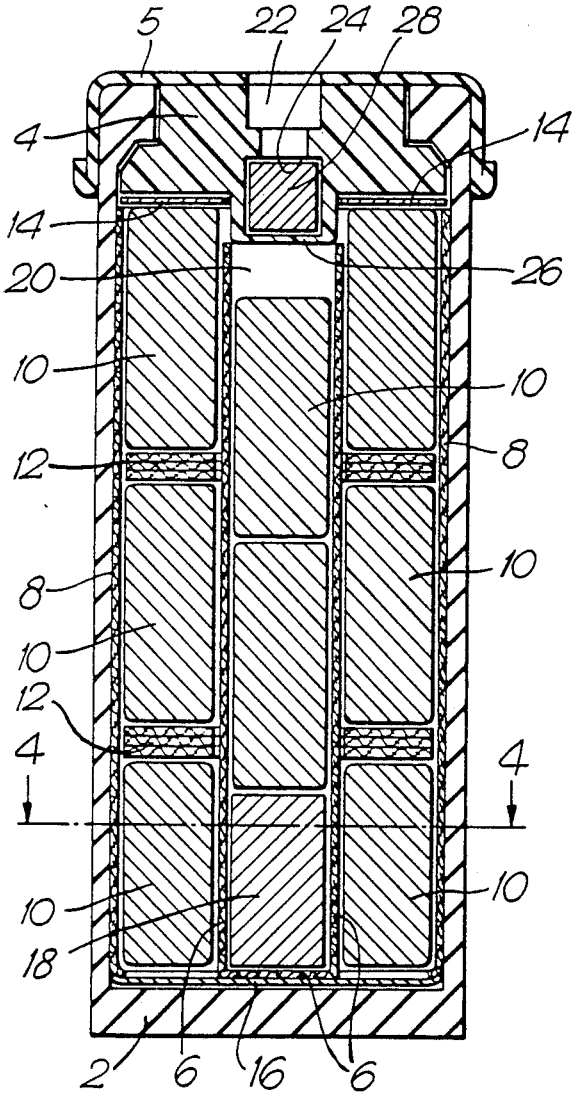

FIG. 4 is a cross-sectional view of the pyrotechnic device of FIG. 3 along line AA', and FIG. 5 is a sectional view of the pyrotechnic device of FIG. 3 along line BB' representing the longitudinal axis of the device.

EXAMPLE 1

A 150 mm×25 mm piece of a medium activity charcoal cloth (RBNS 236) was weighed and was placed for 30 seconds in a heated solution containing between 0.4 and 2.0 g $KNO_3.g^{-1}$ water. The cloth was then removed and held horizontally in a fume cupboard draught for 1 minute before being hung vertically to dry. The cloth was then dried at 80° C. for 1 hour and weighed.

A number of samples of cloth impregnated with $KNO_3$ were prepared in this way. The amount of $KNO_3$ on each sample, which depending largely upon the strength of the $KNO_3$ solution used, was given as $$\frac{\text{weight of } KNO_3 \text{ deposited on cloth}}{\text{weight of dry cloth before impregnation}} \times 100\%$$

Five representative samples of impregnated cloth were selected and were ignited at one end with a windproof match. The observed burning rates of each sample is given in Table 1 below.

TABLE 1

| Sample | % weight of $KNO_3$ on cloth | Time for 150 mm to burn (seconds) | Burning rate (mm $s^{-1}$) |
|---|---|---|---|
| 1A | 100 | 8.0 | 18.75 |
| 1B | 150 | 6.0 | 25 |
| 1C | 270 | 4.0 | 37.5 |
| 1D | 370 | 5.0 | 30 |
| 1E | 460 | 8.1 | 18.5 |

Samples 1A, 1B and 1C left a skeleton cloth after burning, whereas Samples 1D and 1E burned fiercly leaving no remains.

The results given above should be compared with the normal minimum acceptable burning rate for a conventional primed cambric which is about 12.5 mm $s^{-1}$.

EXAMPLE 2

A 150 mm×25 mm piece of a RBNS 236 charcoal cloth was mixed with a 50 ml aqueous solution containing 5–50 mM picric acid for 20 hours at 20° C. The adsorption of picric acid was found from the decrease in absorbance of the solution at 380 nm using a Pye Unicam SP1800 spectrophotometer. The amount of picric acid adsorbed onto a number of samples of RNBS 236 cloth treated by this method was found to vary between 1% and 55% by weight of dry cloth, depending largly upon the concentration of picric acid in the aqueous solution.

Each of the samples of charcoal cloth which had adsorbed 1–55% by weight of picric acid were then placed for 30 seconds in a solution containing between 0.4 and 2.0 g $KNO_3.g^{-1}$ water. Desorption of picric acid was prevented by adding picric acid at the equilibrium solution concentration to the $KNO_3$ solution. The cloth was then removed and held horizontally in a fume cupboard draught for 1 minute before being hung vertically to dry. The cloth was then dried at 80° C. for 1 hour and weighed.

Each dried sample was ignited with a windproof match and the burning rate observed. The type of burning produced at different concentrations of picric acid and $KNO_3$ is shown in FIG. 1. The key to this Figure is given below. The mean burning rate of 62 samples prepared in accordance with this Example was 55 mm.$s^{-1}$ with a standard deviation of 11 mm.$s^{-1}$.

KEY TO FIG. 1

Zone (A) - Cloth may self-extinguish or not ignite
Zone (B) - Cloth burns fiercely and leaves no remains
Zone (C) - Cloth burns weakly and leaves a skeleton cloth
Zone (D) - Cloth burns well and may leave a skeleton cloth
Zone (E) - Cloth will self-extinguish or not ignite
Zone (F) - Burning rate of cloth may decrease It will be appreciated that boundaries between the zones delineated are not distinct, nor do they generally define what is acceptable for use in any particular application although an impregnated cloth within the boundaries of Zone (D) has some advantages over cloths within the boundaries of other zones.

EXAMPLE 3

Samples of charcoal cloth prepared in accordance with Example 1 and containing either 250% or 400% by weight of $KO_3$ deposited thereon were pulled through 10 $cm^3$ solutions of Impranil (300 g.$dm^{-3}$), a polyurethane dispersion marketed by Bayer (UK) Ltd., and dried at 80° C. The burning rates of these samples are given in FIG. 2, the key to which is provided below.

KEY TO FIG. 2

T=Time in seconds for a 150 mm strip of impregnateed charcoal cloth to burn.

| Symbol | Approximate % impregnant $KNO_3$ | Impranil |
|---|---|---|
| | 250 | 0 |
| • | 400 | 0 |
| | 250 | 5 |
| | 400 | 5 |
| Δ | 250 | 20 |
| | 400 | 20 |

$$\% \text{ impregnant} = 100 \times \frac{\text{weight of dry impregnant}}{\text{weight dry charcoal cloth}}$$

F = Flames produced
r = hot skeleton cloth remained after combustion

FIG. 2 shows that the application of Impranil to charcoal cloth containing oxidants decreases the burning rate. However, the addition of Impranil reduces the loss of oxidant crystals on flexure of the cloth, and also improves the resistance of the cloth to abrasion.

Referring now to FIGS. 3 to 5, these illustrate a pyrotechnic device 1 in which conventional primed cambric is replaced by an impregnated charcoal cloth ignition transfer medium according to this invention.

The pyrotechnic device 1 consists of a hollow cylindrical body 2 of rubber which is closed at its open forward end by a solid closure member 4 inserted therein. A cap 5 fitted over the forward end of the body 2 urges the sides of the hollow body 2 against the closure member 4 to provide an environmental seal.

The hollow body 1 contains an inner tube 6 and an outer tube 8 of the present impregnated charcoal cloth which are arranged concentrically and in axial alignment with the longitudinal axis of the hollow cylindrical body. The inner tube 6 and the space between the inner tube 6 and outer tube 8 are filled with closely-fitting cylindrical charges 10 of pyrotechnic composition which are stacked end-to-end.

The stacked cylindrical charges 10 are separated from one another by a small number (typically 5 to 10) of stacked discs 12 of the present impregnated carbon cloth. The array of impregnated carbon cloth pieces is completed by a ring 14 of cloth about the top of the stack of charges 10 and a large disc 16 of cloth at the bottom of the stack. A cylindrical polyethylene spacer 18 situated at the bottom of the stack of charges 10 within the inner tube 6 provides an appropriate space 20 between this stack and the closure member 4.

A cylindrical opening 22 down through the centre of the cap 5 and closure member 4 leads to a chamber 24 isolated from the interior of the hollow body 1 by a membrane 26 of (for example) nylon. The chamber contains a burster charge 28 of gunpowder. The opening 22 is partly screw-threaded to permit the attachment by corresponding threaded engagement of a conventional fuse mechanism (not shown) to allow the insertion of a fuse (not shown) one end of which communicates in direct contact with the charge 28. The type of fuse mechanism will depend on the intended use of the pyrotechnic device. The fuse mechanism of a hand-launched device such as a pyrotechnic grenade will generally include a hand-operated striker mechanism which when operated strikes against a fuse initiator and hence ignites the one end of the fuse remote from the charge 28. The fuse mechanism of a gun or rocket launched pyrotechnic device will generally include a fuse housing comprising an ogival head.

The ignition sequence of the pyrotechnic device 1 is as follows. Once the fuse (not shown) ignites the burster charge 28, the membrane 26 is ruptured the hot combustion gases ignite the charcoal cloth tubes (6, 8), discs (12, 16) and ring (14). The ignited cloth in turn ignites the cylindrical charges 10 of pyrotechnic composition. The hot combustion gases from the burning charcoal cloth and pyrotechnic composition build up pressure within the hollow rubber body 2 which expands and then bursts so scattering the burning pyrotechnic charges 10.

We claim:

1. An ignition transfer medium comprising a fibrous activated carbon support on which an inorganic oxidant has been deposited, the fibrous activated carbon support having an activity, as measured by its specific heat of wetting with silicone, of between 20 and 120 Joules per gram.

2. An ignition transfer medium according to claim 1 wherein the ratio by weight of dry inorganic oxidant to dry fibrous activated carbon in the transfer medium is in the range 1:1 to 10:1.

3. An ignition transfer medium according to claim 1 wherein the inorganic oxidant is selected from the group consisting of the nitrates, nitrites, chlorates, perchlorates, chromates and dichromates of alkali metals and ammonium.

4. An ignition transfer medium according to claim 3 wherein the inorganic oxidant is potassium nitrate and the ratio by weight of dry potassium nitrate to dry fibrous activated carbon in the transfer medium is in the range 1.5:1 to 3.5:1.

5. An ignition transfer medium according to claim 1 wherein the fibrous activated carbon support comprises an activated carbon cloth.

6. An ignition transfer medium according to claim 1 wherein one or more additional substances are deposited on or within the fibrous activated carbon support.

7. An ignition transfer medium according to claim 6 wherein the additional substance comprises an organic energetic compound adsorbed into the fibrous activated carbon support.

8. An ignition transfer medium according to claim 7 wherein the ratio by weight of organic energetic compound to dry fibrous activated carbon support in the ignition transfer medium is in the range 0.02:1 to 1:1.

9. An ignition transfer medium according to claim 7 wherein picric acid is adsorbed into the fibrous activated carbon support.

10. An ignition transfer medium according to claim 9 wherein the inorganic oxidant comprises potassium nitrate and the ratios by weight of dry potassium nitrate and dry picric acid to dry cloth are respectively in the ranges 1:1 to 3.5:1 and 0.05:1 to 0.40:1.

11. An ignition transfer medium according to claim 1 including a binder comprising a polyurethane dispersion.

12. A pyrotechnic device comprising a hollow body, a pyrotechnic charge contained within the hollow body, ignition means for igniting the pyrotechnic charge, and an ignition transfer medium disposed between the ignition means and the pyrotechnic charge, wherein the improvement comprises the ignition transfer medium being a fibrous activated carbon support on which an inorganic oxidant has been deposited, the fibrous activated carbon support having an activity, as measured by its specific heat of wetting with silicone, of between 20 and 120 Joules per gram.

* * * * *